US008950299B2

(12) United States Patent
Wu

(10) Patent No.: US 8,950,299 B2
(45) Date of Patent: Feb. 10, 2015

(54) LOCKING PLIERS

(76) Inventor: Ming-Chieh Wu, Taichung (TW)

( * ) Notice: Subject to any disclaimer, the term of this patent is extended or adjusted under 35 U.S.C. 154(b) by 228 days.

(21) Appl. No.: 13/469,469

(22) Filed: May 11, 2012

(65) Prior Publication Data

US 2013/0014618 A1 Jan. 17, 2013

(30) Foreign Application Priority Data

Jul. 12, 2011 (TW) ..... 100124592 A

(51) Int. Cl.
*B25B 7/12* (2006.01)
*B25B 7/14* (2006.01)

(52) U.S. Cl.
CPC ..... *B25B 7/123* (2013.01)
USPC ..... 81/379; 81/318; 81/370

(58) Field of Classification Search
CPC ..... B25B 7/10; B25B 7/12; B25B 7/123; B25B 7/04
USPC ..... 81/318, 367–370, 372–380
See application file for complete search history.

(56) References Cited

U.S. PATENT DOCUMENTS

| | | | | |
|---|---|---|---|---|
| 4,499,797 | A | 2/1985 | Wilson | |
| 4,989,479 | A | 2/1991 | Anderson et al. | |
| 5,351,585 | A | 10/1994 | Leseberg et al. | |
| 5,520,040 | A * | 5/1996 | Pettersson | 81/352 |
| 7,143,671 | B1 | 12/2006 | Lai | |
| 7,454,999 | B2 * | 11/2008 | Wu | 81/367 |
| 7,861,622 | B2 | 1/2011 | Chervenak et al. | |
| 8,056,451 | B2 | 11/2011 | Chervenak et al. | |
| 2008/0196561 | A1 | 8/2008 | Wu | |
| 2010/0018361 | A1 * | 1/2010 | Chervenak et al. | 81/318 |

FOREIGN PATENT DOCUMENTS

| | | |
|---|---|---|
| CN | 101659014 | 3/2010 |
| CN | 101704227 | 5/2010 |
| EP | 2149428 A1 | 2/2010 |
| TW | M265172 | 5/2005 |
| TW | M313580 | 6/2007 |
| TW | 200924914 | 6/2009 |
| TW | M400919 | 4/2011 |

OTHER PUBLICATIONS

European Search Report from European Application 12170983.6-1251, dated Oct. 22, 2012, 7 pages.

* cited by examiner

*Primary Examiner* — Hadi Shakeri
(74) *Attorney, Agent, or Firm* — Alan D. Kamrath; Kamrath IP Lawfirm, P.A.

(57) ABSTRACT

A locking pliers includes a fixed handle supporting a fixed jaw, a movable jaw, a movable handle pivotally connected to the movable jaw about a pivotal axis, and a movable pivot unit disposed on the fixed handle and the movable jaw. The pivot unit includes a pivot pin and a pivot hole configured to loosely receive the pivot pin such that, when a manual turning force is applied to the movable handle, the movable jaw is turned clockwise to a locking position. As a result of abutting engagement between the pivot pin and a leading region of the pivot hole, a friction force is generated to hold the movable jaw in a tightening position. The gripping force between fixed and movable clamping surfaces of the jaws can be firm and stable.

4 Claims, 12 Drawing Sheets

LOCKING PLIERS

CROSS-REFERENCE TO RELATED APPLICATION

This application claims priority of Taiwanese Patent Application No. 100124592, filed on Jul. 12, 2011, the disclosure of which is herein incorporated by reference.

BACKGROUND OF THE INVENTION

1. Field of the Invention

This invention relates to a locking pliers and, more particularly, to a locking pliers that can be held firmly in a closed and locked position without the continuous application of force by a user while tightly gripping a workpiece.

2. Description of the Related Art

Referring to FIG. 1, a conventional locking pliers 10 disclosed in U.S. Pat. No. 7,861,622 B2 is shown to include a fixed handle 11 supporting a fixed jaw 12, a movable jaw 14 pivotally connected to the fixed handle 11 by a first pivot pin 13, a movable handle 16 pivotally connected to the movable jaw 14 by a second pivot pin 15, and a toggle-link locking mechanism 17 disposed to lock the movable jaw in a closed, locked position. The fixed handle 11 has an oval slotted aperture 111, such that the first pivot pin 13 is movable in the aperture 111 during use of the locking pliers 10. A long axis of the aperture 111 is arranged at an angle $\alpha$ with respect to a line extending through the center of the fixed and movable jaws 12, 14 when closed. The angle $\alpha$ is approximately 15°. The toggle-link locking mechanism 17 has a link 173 pivotally connected to the movable handle 16 and in sliding and pivoting contact with an adjustment screw 171, and a biasing member 172 extending between the movable jaw 14 and the fixed handle 11 to bias the fixed and movable jaws 12, 14 away from each other.

Referring to FIGS. 2 and 3, in operation, when the pliers is first locked onto a workpiece 20 and a turning force is applied to the pliers, the movable jaw 14 rotates clockwise around the second pivot pin 15 toward the fixed jaw 12 to allow rearward movement of the first pivot pin 13 in the aperture 111. The movable jaw 14 is also moved rearward and toward the fixed jaw 12, as indicated by arrows 21 and 22, to increase the gripping force on the workpiece 20. However, since the first pivot pin 13 is moved to a rear end of the aperture 111 when the fixed and movable jaws 12, 14 are operated to the closed, locked position, the sliding engagement of the first pivot pin 13 with a wall defining the aperture 111 may be unstable, thereby adversely affecting the gripping force on the workpiece 20.

SUMMARY OF THE INVENTION

An object of the present invention is to provide a locking pliers which can exert a firm and stable gripping force onto a workpiece while being held firmly in a closed and locked position without continuous application of force by a user.

According to this invention, the locking pliers includes a fixed handle having front and rear handle portions opposite to each other in a longitudinal direction; a fixed jaw having a first connected portion which is connected securely to the front handle portion, and a first working portion which extends forwardly from the first connected portion to terminate at a first nose end; a movable jaw having a second connected portion which extends in a transverse direction to terminate at movable and fixed pivoting regions, and a second working portion which extends forwardly from the second connected portion to terminate at a second nose end; a movable handle having a front pivot portion which is pivotally connected to the fixed pivoting region about a pivotal axis in an axial direction, and a rear actuating portion which extends rearwardly from the front pivot portion; a movable pivot unit including a pivot pin which is disposed on one of the front handle portion and the movable pivoting region and which extends along a pivot axis, and a pivot hole which is disposed in the other one of the front handle portion and the movable pivoting region, which is defined by an inner tubular surface that has leading, middle and trailing regions in a counterclockwise direction, and which is configured and dimensioned to loosely receive the pivot pin, such that the pivot pin is angularly displaceable relative to the inner tubular surface among initial, locking, and tightening positions where the pivot pin is in abutting engagement with the trailing, middle and leading regions, respectively; a biasing member disposed between the fixed handle and the second connected portion to bias the pivot pin toward the initial position; and a lock unit disposed to guard the movable jaw against the displacement from the locking position toward the initial position by counteracting the biasing action of the biasing member once a manual turning force which is applied to the movable handle to turn the movable pivoting region of the movable jaw clockwise about the pivotal axis to the locking position is removed, thereby locking the pivot pin at the locking position. The leading and trailing regions are disposed opposite to each other relative to the pivot pin, such that, once the manual turning force which is continuously applied to the movable handle to further turn the movable pivoting region clockwise about the pivotal axis is removed, a friction force generated as a result of the abutting engagement between the pivot pin and the leading region counteracts the biasing action of the biasing member to prevent the pivot pin from moving away from the tightening position.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENT

Figure 1:
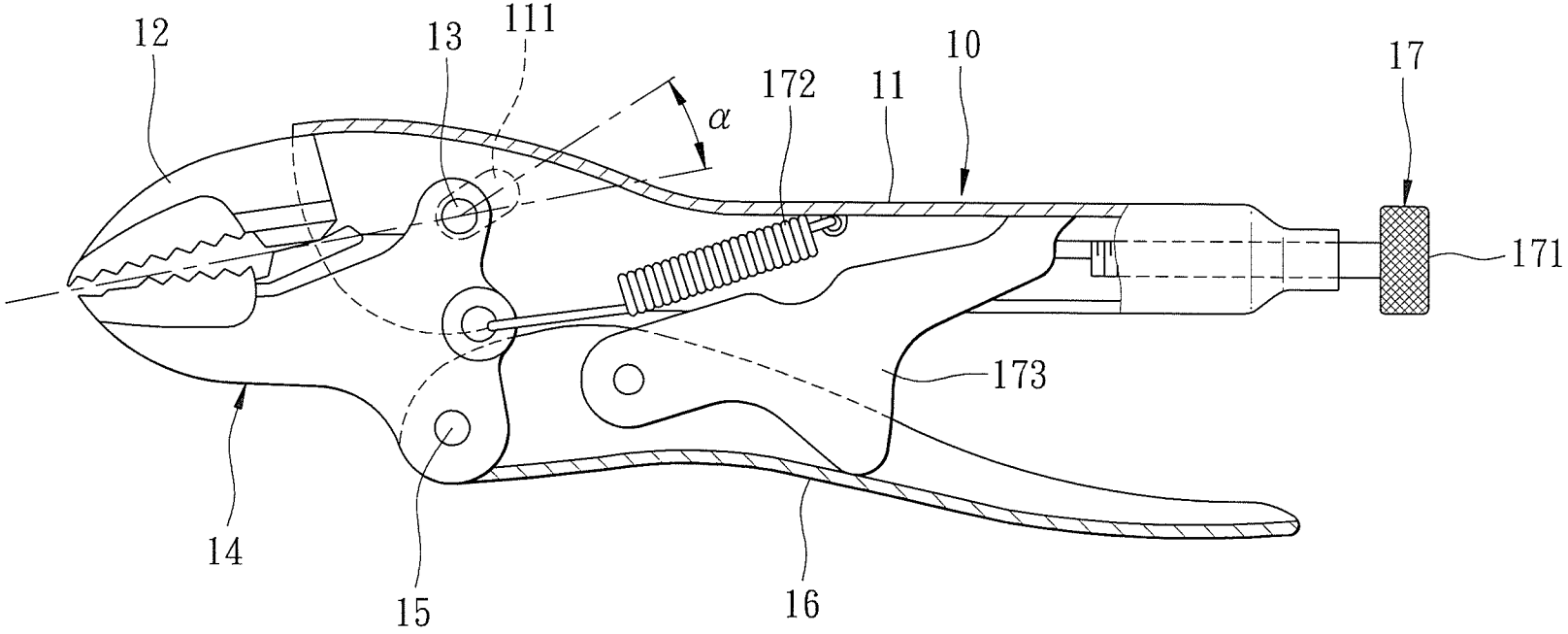
FIG. 1 PRIOR ART
FIG. 1 is a partially sectioned side view of a conventional locking pliers disclosed in U.S. Pat. No. 7,861,622 B2 in a closed and locked position.
Figure 2:
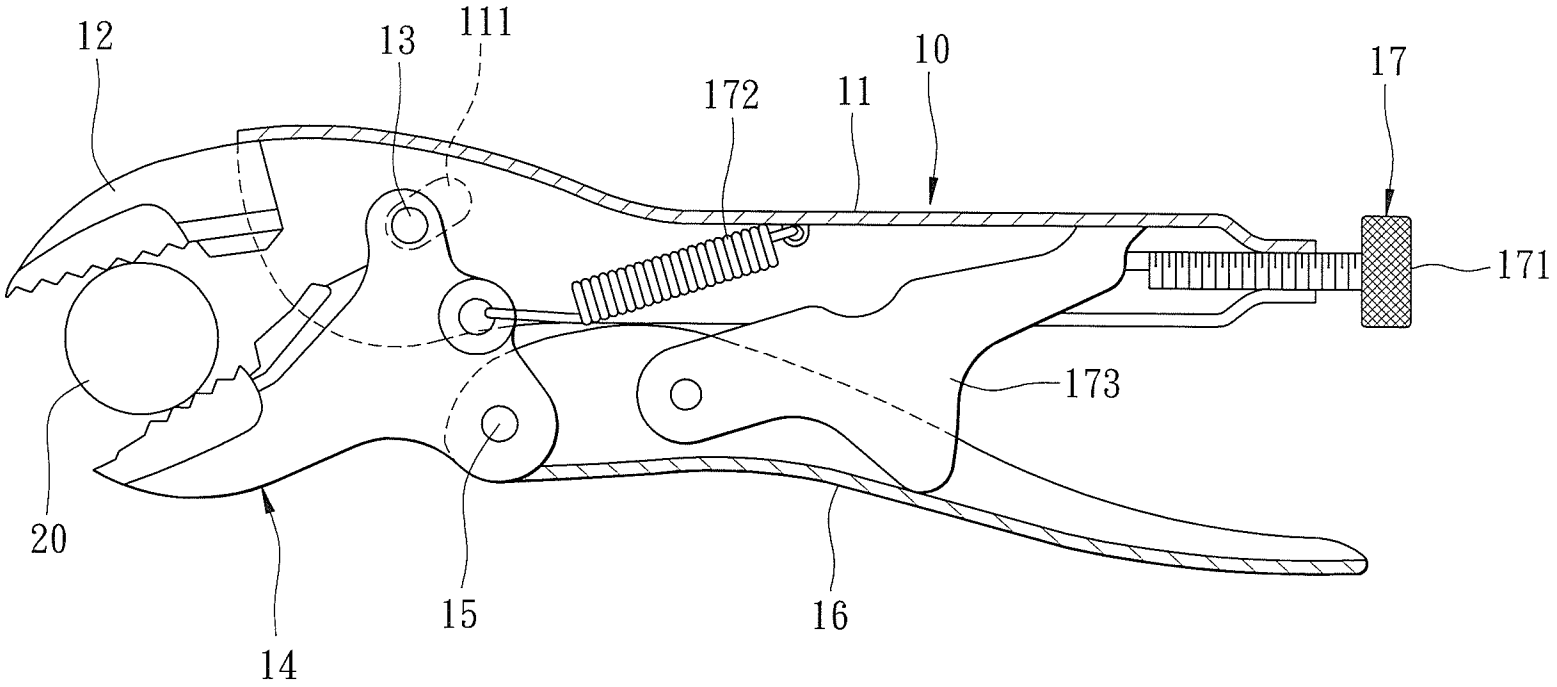
FIG. 2 PRIOR ART
FIG. 2 is a partially sectioned side view of the conventional locking pliers in its closed, locked position on a workpiece.
Figure 3:
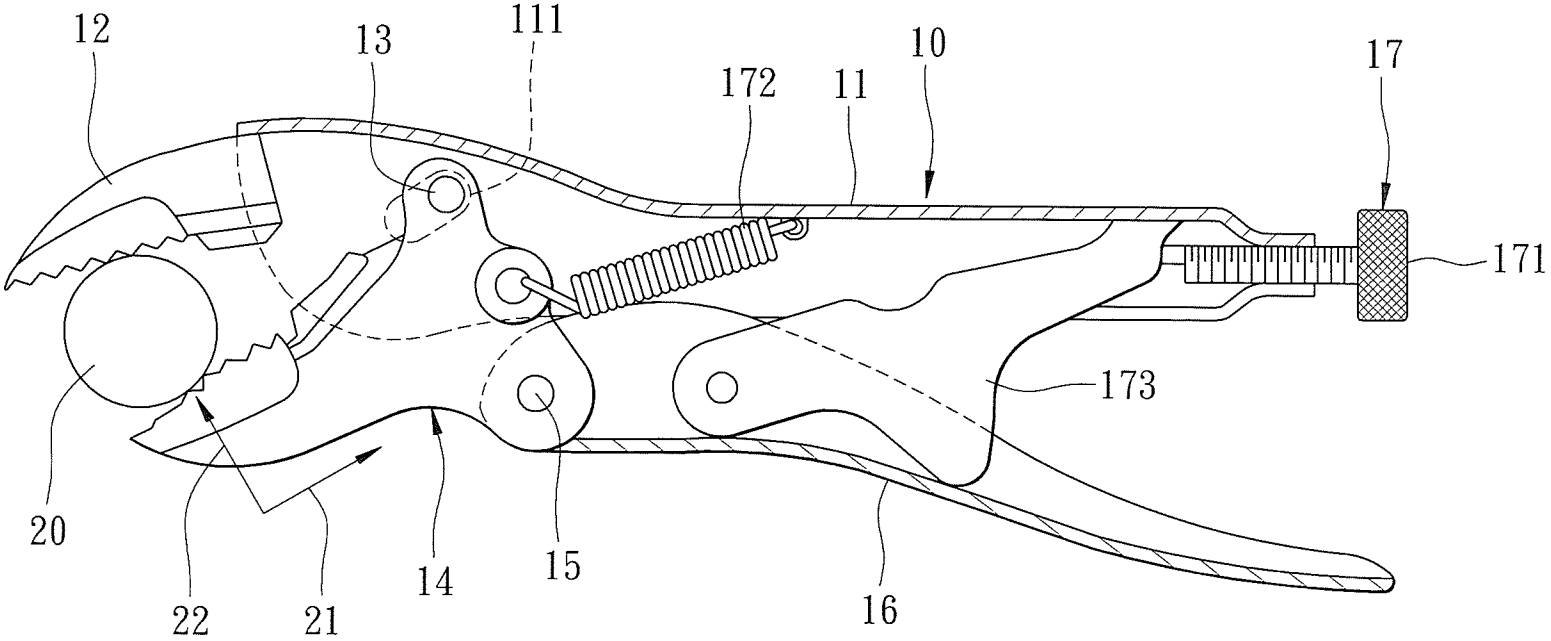
FIG. 3 PRIOR ART
FIG. 3 is a partially sectioned side view of the conventional locking pliers in its closed, locked position on a workpiece with a turning force applied to the pliers.
Figure 4:
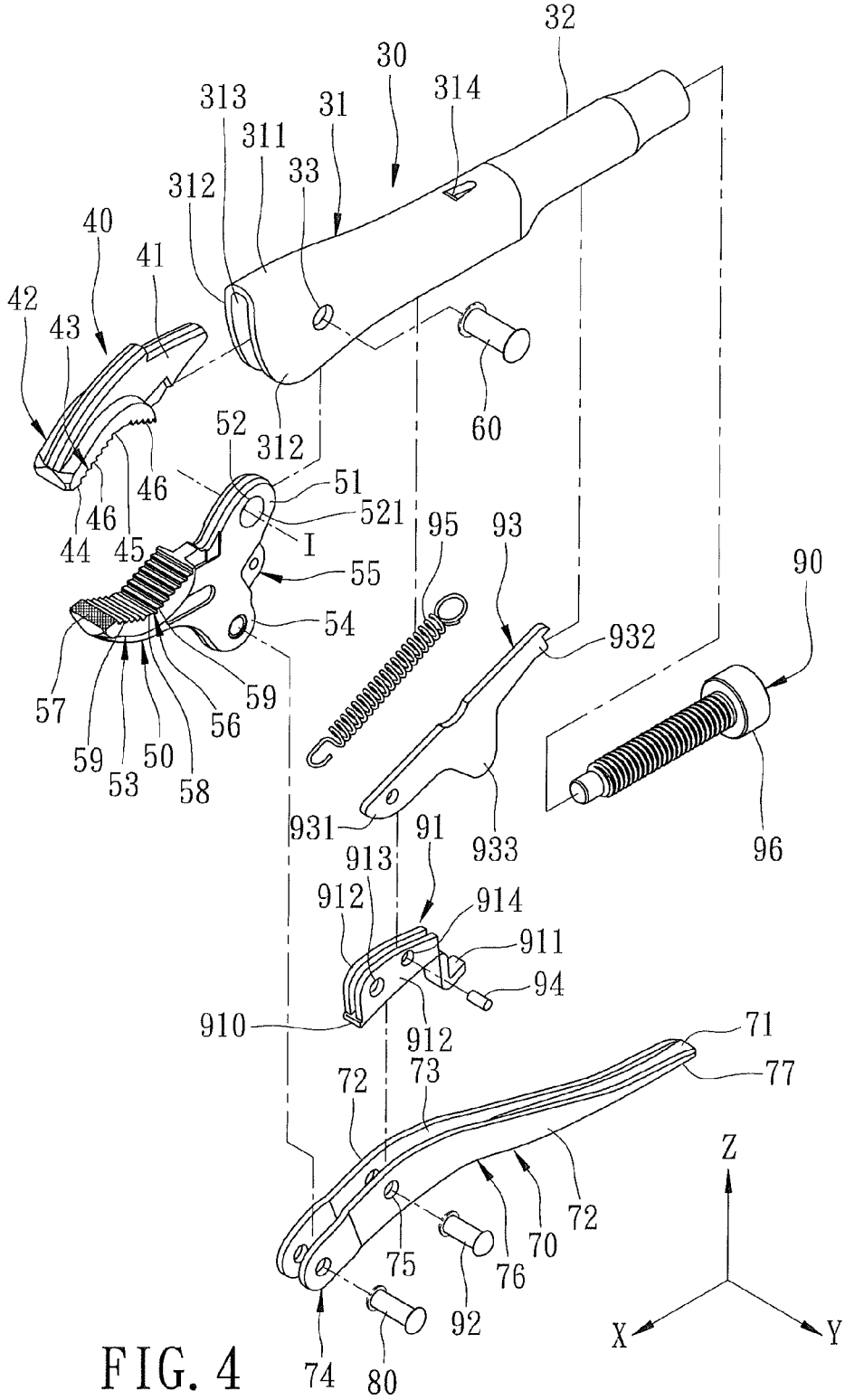
FIG. 4 is an exploded perspective view of the preferred embodiment of a locking pliers according to this invention.
Figure 5:
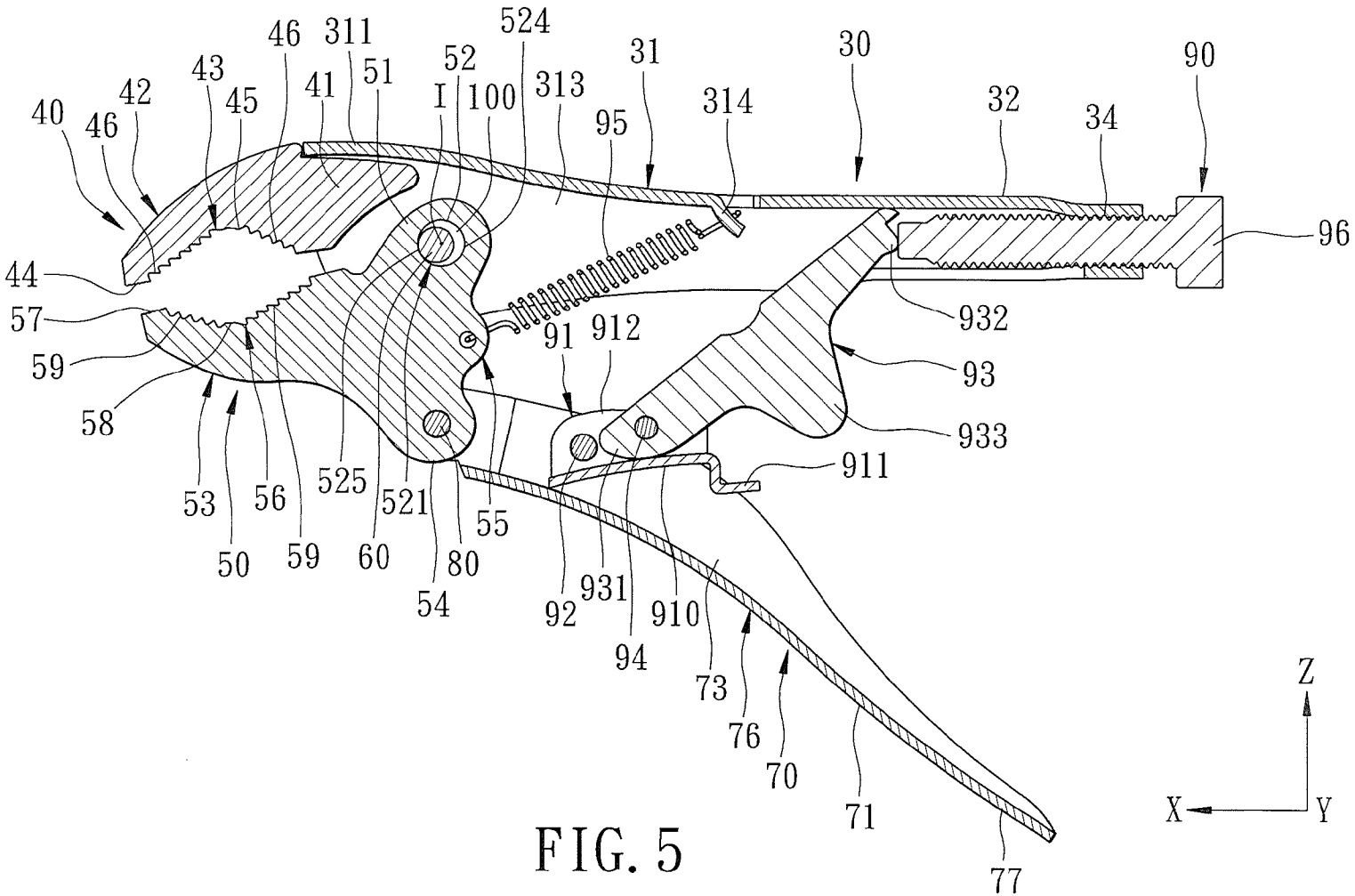
FIG. 5 is a partially sectioned side view of the preferred embodiment in an opened state.

Referring to FIGS. 4 and 5, the preferred embodiment of a locking pliers according to the present invention is shown to comprise a fixed handle 30, a fixed jaw 40, a movable jaw 50, a movable handle 70, a movable pivot unit, a biasing member 95, and a lock unit 90.

The fixed handle 30 has front and rear handle portions 31, 32 opposite to each other in a longitudinal direction (X). A pivot hole 33 and a screw hole 34 are formed in the front handle portion 31 and the rear handle portion 32, respectively. In this embodiment, the front handle portion 31 is in the form of a grooved plate which includes an upper plate 311 and a pair of side plates 312 extending from the upper plate 311 in a transverse direction (Z) transverse to the longitudinal direction (X) to cooperatively define a recess 313. The pivot and screw holes 33, 34 communicate with the recess 313. A tab 314 extends from the upper plate 311 and into the recess 313.

The fixed jaw 40 has a first connected portion 41 which is connected securely to the front handle portion 31, and a first working portion 42 which extends forwardly from the first connected portion 41 to terminate at a first nose end 44 having a flat surface. The first working portion 42 has a fixed clamping surface 43 which is disposed immediately rearward from the first nose end 44, which faces in the transverse direction (Z), and which is formed with gripping teeth 46 extending from the first nose end 44 along a concaved contour 45.

The movable jaw 50 has a second connected portion 55 which extends in the transverse direction (Z) to terminate at movable and fixed pivoting regions 51, 54, and a second working portion 53 which extends forwardly from the second connected portion 55 to terminate at a second nose end 57 having a flat surface. The second working portion 53 has a movable clamping surface 56 which is disposed immediately rearward from the second nose end 57, which confronts the fixed clamping surface 43, and which is formed with gripping teeth 59 extending rearwardly from the second nose end 57 along a concaved contour 58.

The movable handle 70 has a front pivot portion 74 which is pivotally connected to the fixed pivoting region 54 by a pivotal pin 80 about a pivotal axis in an axial direction (Y) that is transverse to the longitudinal and transverse directions (X, Z), and a rear actuating portion 76 which extends rearwardly from the front pivot portion 74 to terminate at a movable handle end 77 that is manually operable. In this embodiment, the movable handle 70 is in the form of a grooved plate which includes a base seat 71 and a pair of wings 72 which extend from the base seat 71 in the transverse direction (Z) and which are spaced apart from each other in the axial direction (Y) to cooperatively define a concavity 73.

Figure 12:
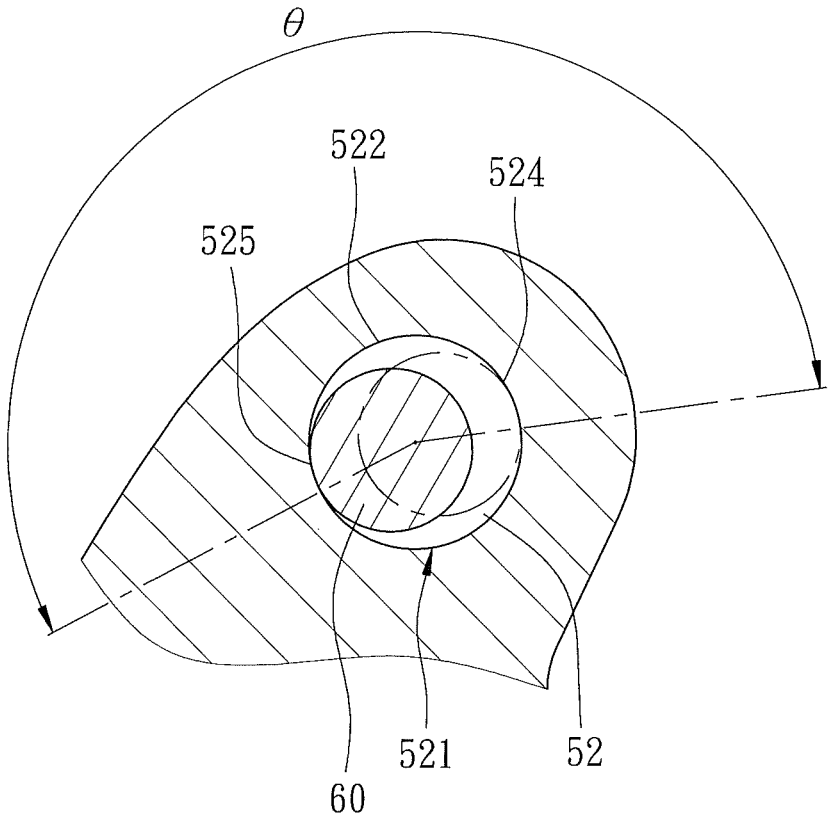
FIG. 12 is a fragmentary sectional view of a movable pivot unit of the preferred embodiment.

Referring to FIGS. 5 and 12, a movable pivot unit includes a pivot pin 60 and a pivot hole 52. The pivot pin 60 is disposed on the front handle portion 31 through the pivot hole 33 and extends along a pivot axis parallel to the pivotal axis of the pivotal pin 80. The pivot hole 52 is disposed in the movable pivoting region 51 of the movable jaw 50. Alternatively, the pivot pin 60 may be disposed on the movable pivoting region 51 of the movable jaw 50 while the pivot hole 52 is disposed in the front handle portion 31. The pivot hole 52 is defined by an inner tubular surface 521. In this embodiment, the inner tubular surface 521 extends along a circular contour which defines a central axis (I) and which has leading, middle and trailing regions 524, 522, 525 that are angularly displaced from one another about the central axis (I) and in a counterclockwise direction. The pivot hole 52 has a diameter larger than that of the pivot pin 60 to loosely receive the pivot pin 60. The leading and trailing regions 524, 525 are disposed opposite to each other relative to the pivot pin 60. In this embodiment, a subtended angle (0) between the leading and trailing regions 524, 525 ranges from 180° to 270°. Alternatively, the subtended angle may range from 90° to 180°. Thus, the pivot pin 60 is angularly displaceable relative to the inner tubular surface 521 among initial, locking, and tightening positions, where the pivot pin 60 is in abutting engagement with the trailing, middle and leading regions 525, 522, 524, respectively, and where the movable clamping surface 56 is close, closer and closest to the fixed clamping surface 43, respectively, as will be described hereinafter.

The biasing member 95 is connected to the tab 314 and the second connected portion 55 to bias the movable jaw 50 toward the initial position. In this embodiment, the biasing member 95 is a tension spring.

The lock unit 90 is a toggle locking assembly which includes a first linkage 91 and a second linkage 93. The first linkage 91 is disposed in the concavity 73. The first linkage 91 has a first proximate end 913 pivoted to the rear actuating portion 76 of the movable handle 70 by a first linking pin 92 about a first linking axis, and has a first distal end 914. In this embodiment, the first linkage 91 is a grooved plate which has a lever wall 910 that extends rearward to terminate at a power end 911, and which has a pair of side walls 912 that extend in the transverse direction (Z) from the lever wall 910. The second linkage 93 has a second proximate end 931 which is pivoted to the first distal end 914 by a second linking pin 94 about a second linking axis, a second distal end 932 which is disposed in the recess 313 to be slidably and retainingly engaged with the rear handle portion 32 and which is contact with an adjustment screw 96 that is threadedly engaged with the screw hole 34, and a protrusion 933 which extends rearward to serve as a stop.

In this embodiment, each of the pivot pin 60, the pivotal pin 80, and the first and second linking pins 92, 94 is a rivet.

During operation, as shown in FIGS. 4 and 5, when the movable handle 70 is forced away from the fixed handle 30 such that the movable jaw 50 is displaced to the initial position, the power end 911 of the first linkage 91 is turned by the second linkage 93 about the first linking axis to be spaced apart from the base seat 71 in the transverse direction (Z), and the pivot pin 60 is in abutting engagement with the trailing region 525, and is spaced apart from the leading region 524 by a rear clearance 100.

Figure 6:
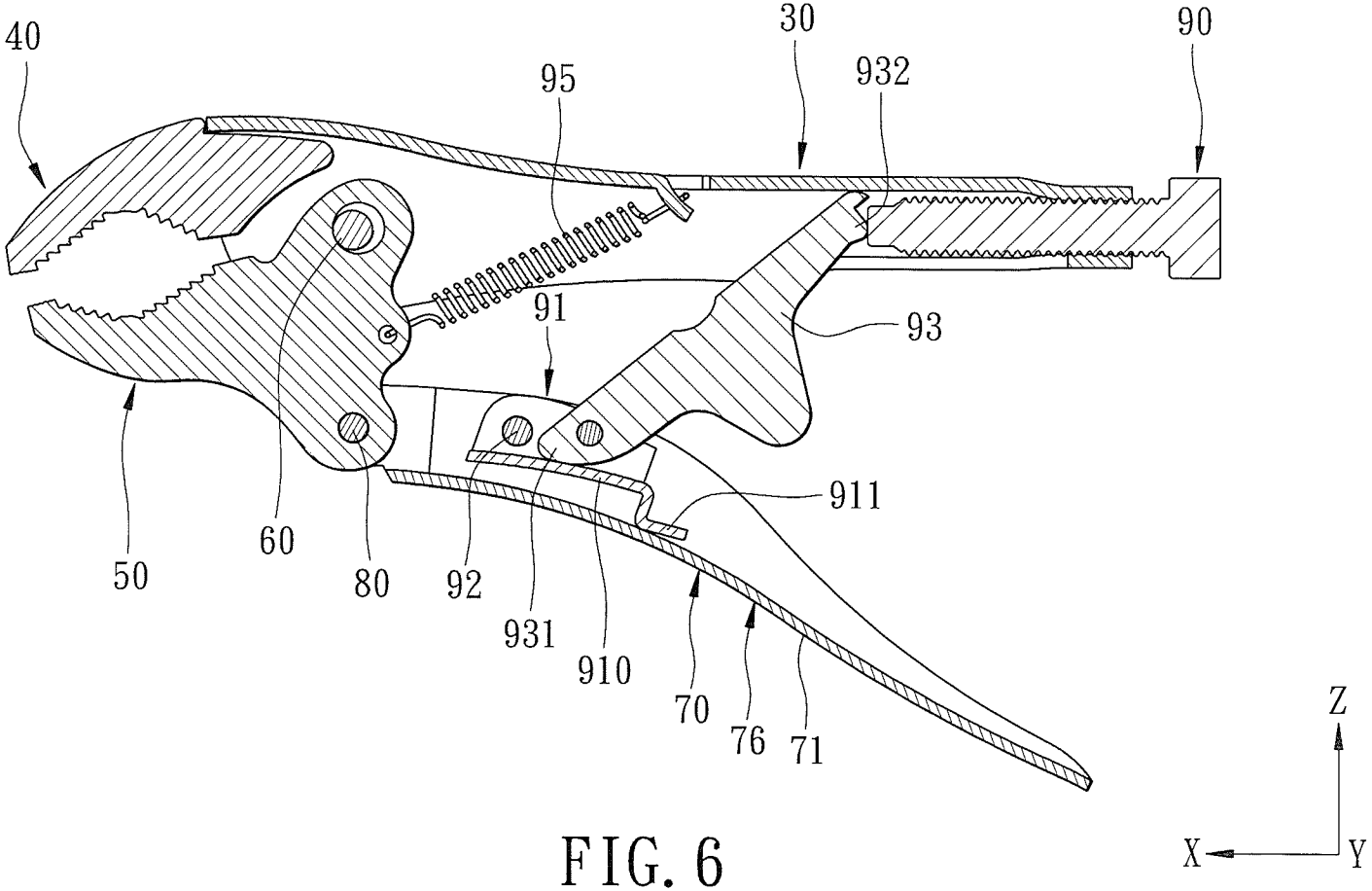
FIG. 6 is a partially sectioned side view of the preferred embodiment in an initially operating state.

As shown in FIGS. 5 and 6, when a manual turning force is applied to the movable handle 70 toward the fixed handle 30 to permit the power end 911 to contact with the base seat 71, the movable jaw 50 is turned toward the fixed jaw 40.

Figure 7:
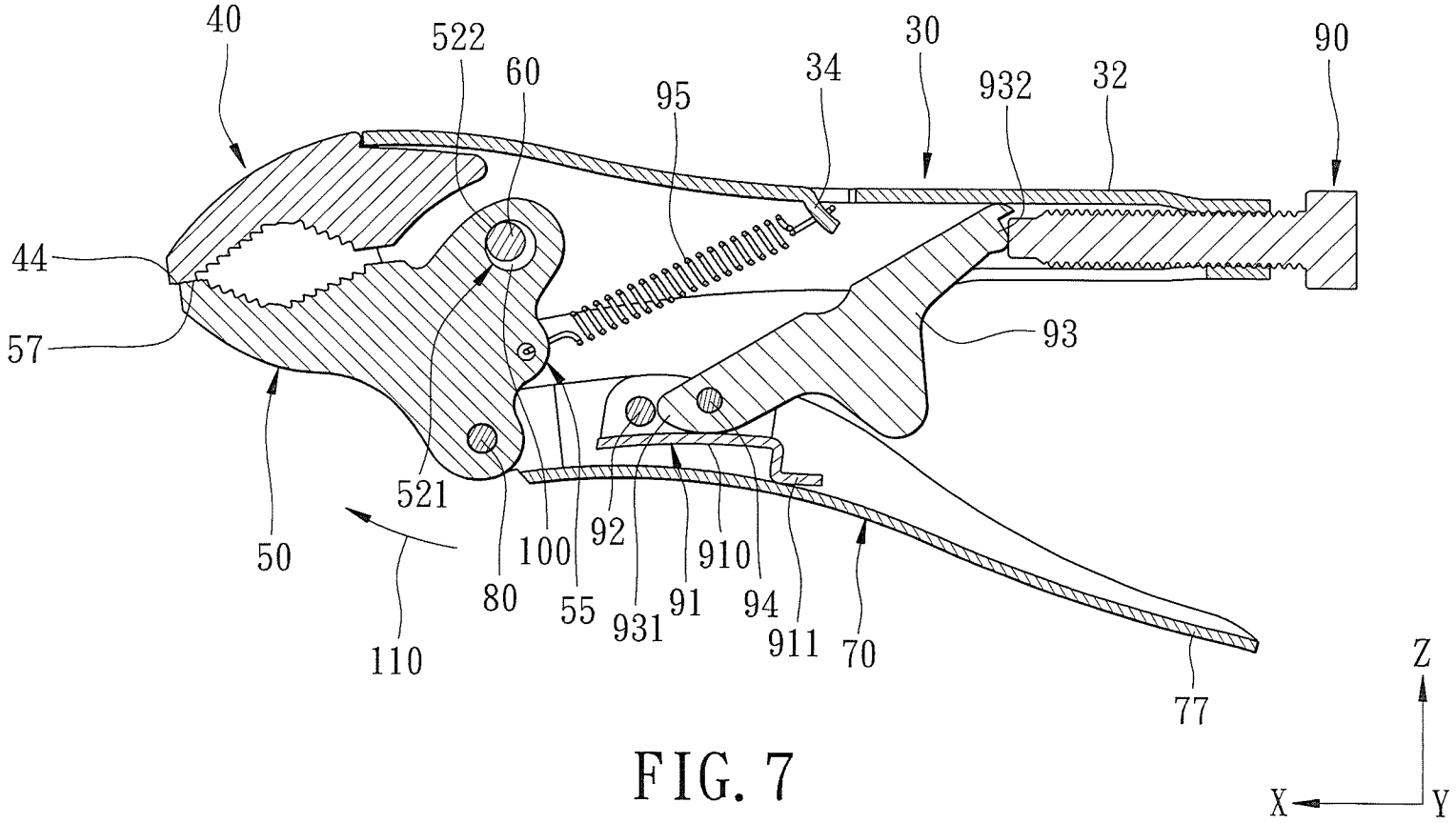
FIG. 7 is a partially sectioned side view of the preferred embodiment in a locking state.

As shown in FIGS. 6 and 7, subsequently, when the manual turning force is continued to be applied to the movable handle 70, the second linkage 93 is turned clockwise about the second linking axis of the second linking pin 94. Hence, the movable jaw 50 is turned clockwise as indicated by the arrow 110 about the pivotal axis of the pivotal pin 80 against the biasing action of the biasing member 95, until the second nose end 57 abuts against the first nose end 44 to be displaced to the locking position, where the pivot pin 60 is in abutting engagement with the middle region 522 to form a lower portion of a clearance 100 between the pivot pin 60 and the inner tubular surface 521. Meanwhile, when the movable jaw is displaced from the initial position to the locking position, the lever wall 910 urges the second proximate end 931 to displace to a first over-center position, where the pivotal axis of the pivotal pin 80, the second linking axis of the second linking pin 94, and the second distal end 932 are in a near straight line with the first linking axis of the first linking pin 92, thereby holding the movable jaw 50 in the locking position.

Figure 8:
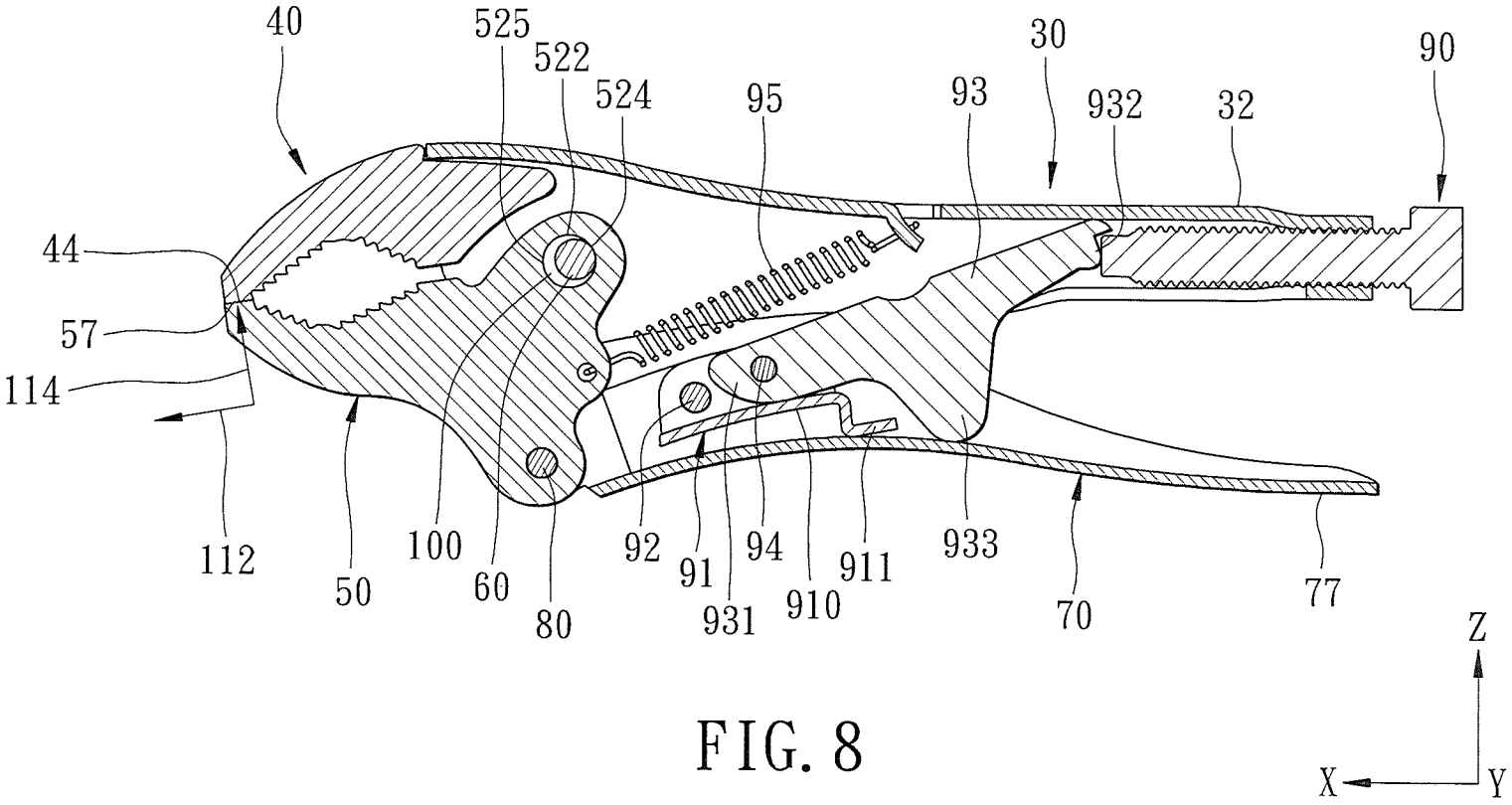
FIG. 8 is a partially sectioned side view of the preferred embodiment in a tightening state.

As shown in FIGS. 7 and 8, when the manual turning force is continued to be applied to the movable handle end 77 toward the rear handle portion 32 to permit the protrusion 933 to contact with the base seat 71, the movable jaw 50 is forced to turn clockwise about the pivotal axis of the pivotal pin 80. The movable jaw 50 is not turned clockwise due to abutment of the first and second nose ends 44, 57 while a force component is generated to move the movable jaw 50 in a direction 112 to permit the pivot pin 60 to be in abutting engagement with the leading region 524 to be spaced apart from the trailing region 525 by a front portion of the clearance 100, and a force component is generated to move the movable jaw 50 in a direction 114 to bring the flat surfaces of the first and second nose ends 44, 57 into full abutment with each other. Meanwhile, when the movable jaw 50 is displaced from the locking position to the tightening position, the second proximate end 931 is urged by the wall lever 910 to turn about the second linking axis of the second linking pin 94 to be shifted to a second over-center position, where the pivotal axis of the pivotal pin 80, the second linking axis of the second linking pin 94, and the second distal end 932 are in a substantially straight line with the first linking axis of the first linking pin 92, thereby holding the movable jaw 50 in the tightening position.

Therefore, once the manual turning force ceases to be exerted on the movable handle 70 after continuing on turning the movable jaw 50 clockwise about the pivotal axis of the pivotal pin 80, a friction force generated as a result of the abutting engagement between the pivot pin 60 and the leading region 524 counteracts the biasing action of the biasing member 95 to prevent the movable clamping surface 56 from moving away from the tightening position. As a result, the gripping force between the fixed and movable clamping surfaces 43, 56 is firm and stable during the operation of the locking pliers to the tightening position.

When it is desired to release the movable jaw 50 from the tightening position, an opposite manual turning force is applied to the movable handle 70 away from the rear handle portion 32 to permit the movable jaw 50 to move back to the initial position by the biasing action of the biasing member 95.

Figure 9:
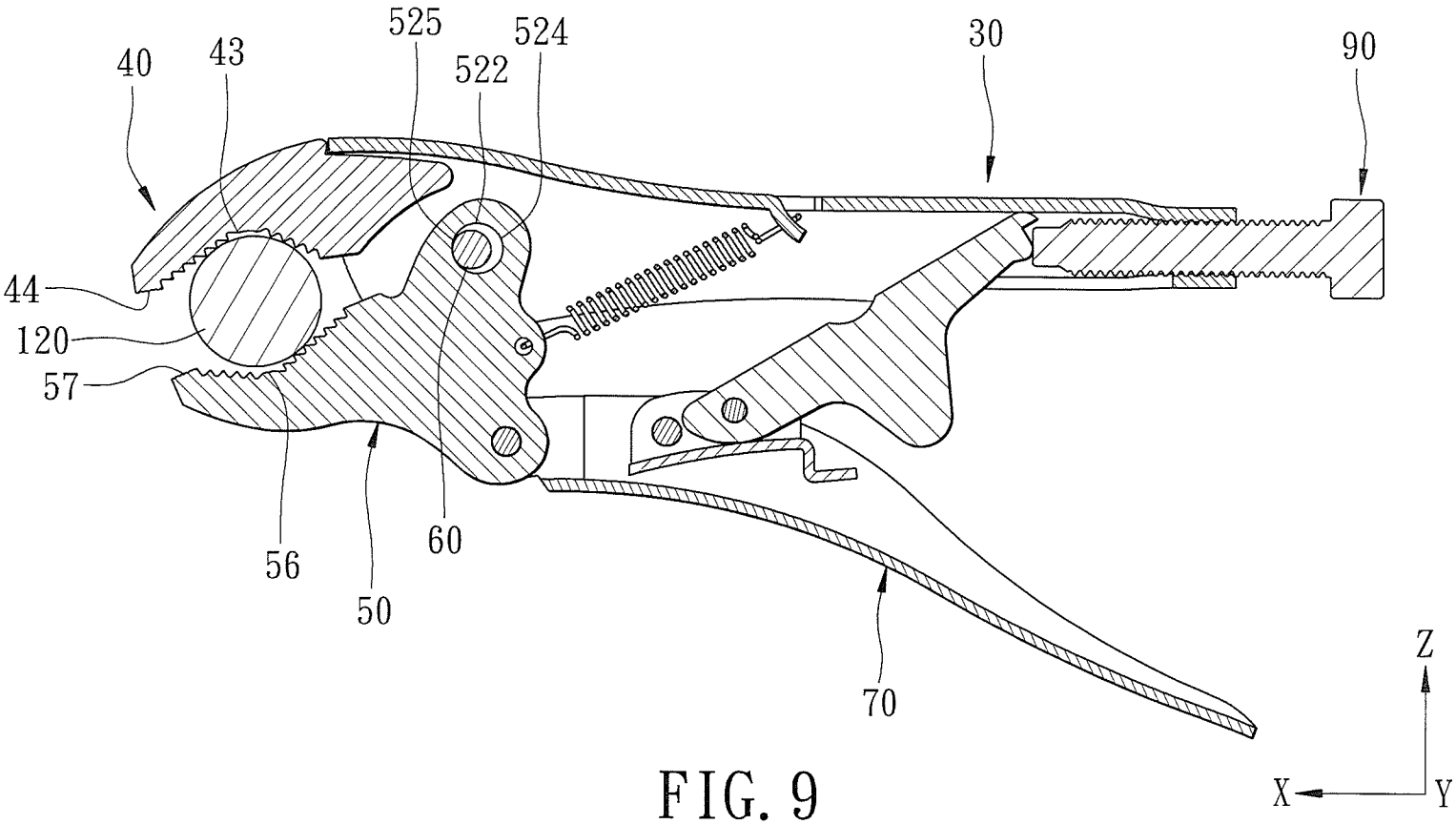
FIG. 9 is a partially sectioned side view of the preferred embodiment in a gripping state where a workpiece is gripped thereon.
Figure 10:
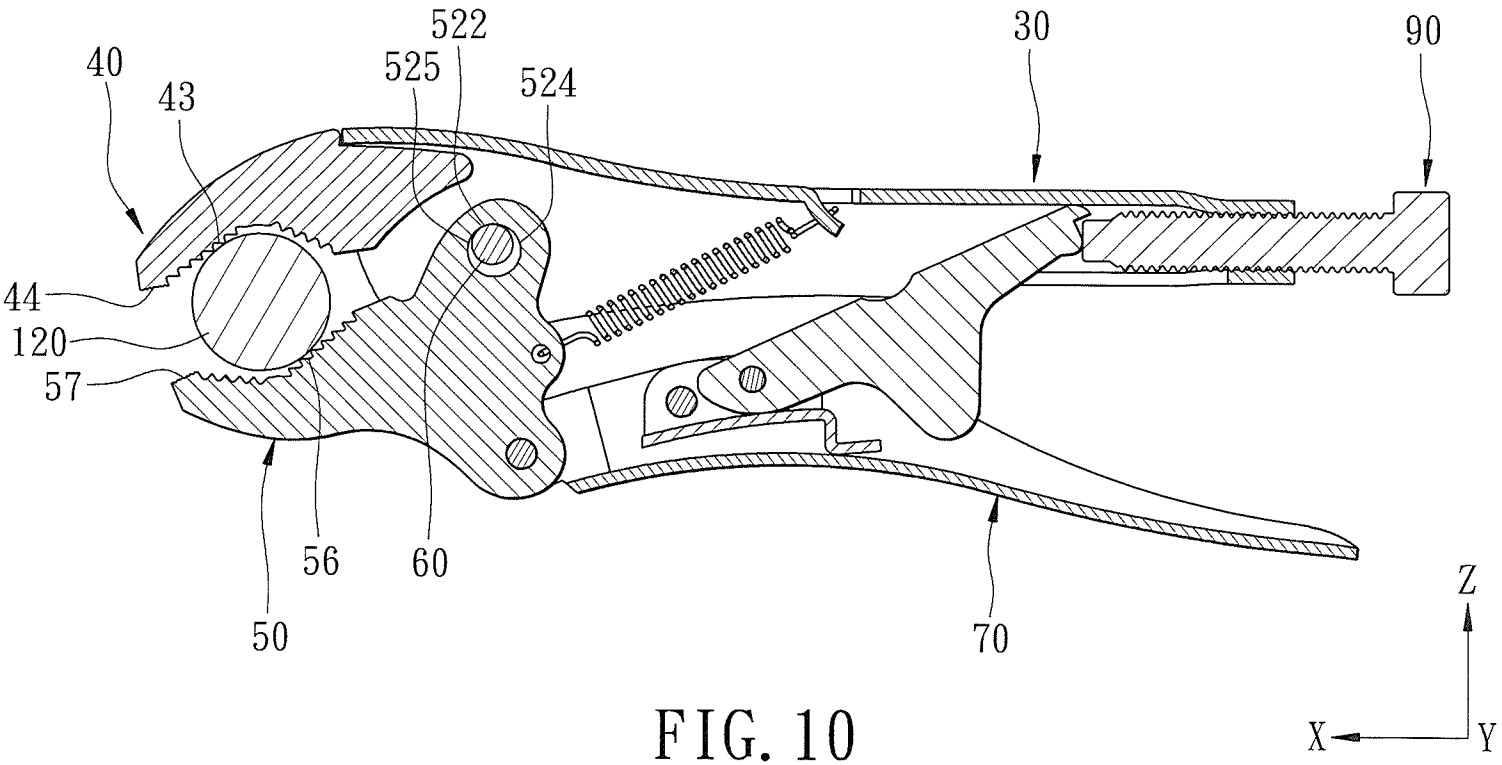
FIG. 10 is a partially sectioned side view of the preferred embodiment in a locking state on the workpiece.
Figure 11:
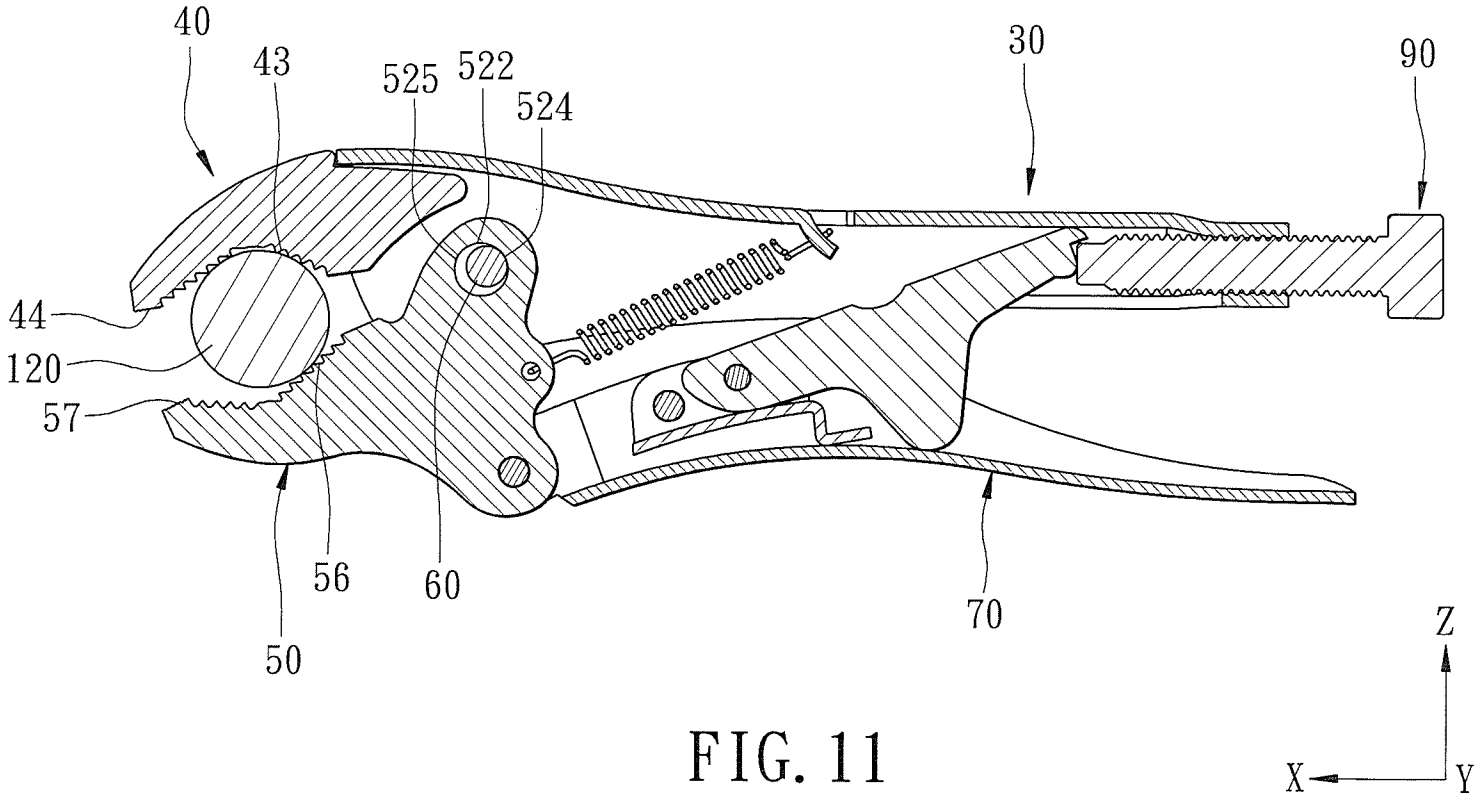
FIG. 11 is a partially sectioned side view of the preferred embodiment in a tightening state on the workpiece.

In use, referring to FIGS. 9 to 11, a workpiece 120 is shown to be gripped by the fixed and movable clamping surfaces 43, 56 with the concaved gripping teeth 46, 59. Firstly, the movable jaw 50 is opened relative to the fixed jaw 40 to place the workpiece 120 therebetween. Subsequently, the movable handle 70 is turned toward the rear handle portion 32 to turn the movable jaw 50 toward the fixed jaw 40 to thereby permit the fixed and movable clamping surfaces 43, 56 to lock on the workpiece 120. Finally, the manual turning force is continued to be applied to the movable handle 70 to bring the movable jaw 50 to be displaced to the tightening position.

As illustrated, since the pivot pin 60 is kept in abutting engagement with the inner tubular surface 521 during the operation of the locking pliers, and since the movable jaw 50 is moved forward and toward the fixed jaw 40 when the manual turning force is further applied to the movable handle 70 to displace the movable jaw 50 from the locking position to the tightening position, the gripping force is increased and stable.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

I claim:

1. A locking pliers comprising:

a fixed handle having front and rear handle portions opposite to each other in a longitudinal direction;

a fixed law having a first connected portion connected securely to said front handle portion, and having a first working portion extending forwardly from said first connected portion to terminate at a first nose end;

a movable jaw having a second connected portion extending in a transverse direction to terminate at movable and fixed pivoting regions, and having a second working portion extending forwardly from said second connected portion to terminate at a second nose end;

a movable handle having a front pivot portion pivotally connected to said fixed pivoting region about a pivotal axis in an axial direction transverse to the longitudinal and transverse directions, and having a rear actuating portion extending rearwardly from said front pivot portion;

a movable pivot unit comprising:

a pivot pin disposed on one of said front handle portion and said movable pivoting region and extending along a pivot axis parallel to the pivotal axis, and a pivot hole disposed in, another one of said front handle portion and said movable pivoting region, with the pivot hole defined by an inner tubular surface having leading, middle and trailing regions in a counterclockwise direction, with said pivot hole configured and dimensioned to loosely receive said pivot pin;

wherein said pivot pin is angularly displaceable relative to said inner tubular surface among initial, locking, and tightening positions where said pivot pin is in abutting engagement with said trailing, middle and leading regions, respectively;

a biasing member disposed between said fixed handle and said second connected portion to bias said pivot pin toward an initial position; and a lock unit disposed to guard said movable jaw against displacement from a locking position toward the initial position by counteracting a biasing action of said biasing member once a manual turning force is applied to said movable handle to turn said movable pivoting region of said movable jaw clockwise about the pivotal axis to the locking position is removed, thereby locking said pivot pin at the locking position;

with said leading and trailing regions disposed opposite to each other relative to said pivot pin, wherein once the manual turning force continuously applied to said movable handle to further turn said movable pivoting region clockwise about the pivotal axis is removed, a friction force generated as a result of the abutting engagement between said pivot pin and said leading region counteracts the biasing action of said biasing member to prevent said pivot pin from moving away from a tightening position;

wherein said inner tubular surface defining a central axis with said leading region, said middle region and said trailing region angularly displaced to one another about the central axis, with said inner tubular surface having a diameter larger than that of said pivot pin; and wherein the locking unit comprises:

a first linkage pivotally connected to the rear actuating portion about a first link axis, wherein the first linkage comprises a lower wall terminating in a power end, with a pair of side walls extending in the transverse direction from the lower wall;

a second linkage pivotally connected to the first linkage, with the second linkage pivotally connected between the pair of side walls spaced from and parallel to the first link axis, wherein the power end is spaced from the lower wall in the transverse direction and abuts with the movable handle spaced in the longitudinal direction from the first link axis; and an adjustment screw threadably engaged with the rear handle portion and abutting against the second linkage.

2. The locking pliers as claimed in claim 1, wherein a subtended angle between said leading and trailing regions ranges from 180° to 270°.

3. The locking pliers as claimed in claim 1, wherein said lock unit is a toggle locking assembly.

4. The locking pliers as claimed in claim 1, wherein each of said first and second nose ends has a flat surface, with said first working portion having a fixed clamping surface and said second working portion having a movable clamping surface, and with each of said fixed and movable clamping surfaces formed with gripping teeth which extend rearwardly from said flat surface of a respective one of said first and second nose ends along a concaved contour.

* * * * *